US011028646B2

(12) United States Patent
Ren et al.

(10) Patent No.: US 11,028,646 B2
(45) Date of Patent: Jun. 8, 2021

(54) HYBRID ROTARY STEERABLE SYSTEM AND METHOD

(71) Applicant: General Electric Company, Schenectady, NY (US)

(72) Inventors: Zhiguo Ren, Shanghai (CN); Xu Fu, Shanghai (CN); Stewart Blake Brazil, Oklahoma City, OK (US); Chengbao Wang, Oklahoma City, OK (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 16/488,976

(22) PCT Filed: Feb. 23, 2018

(86) PCT No.: PCT/US2018/019508
§ 371 (c)(1),
(2) Date: Aug. 27, 2019

(87) PCT Pub. No.: WO2018/160464
PCT Pub. Date: Sep. 7, 2018

(65) Prior Publication Data

US 2019/0376344 A1 Dec. 12, 2019

(30) Foreign Application Priority Data

Feb. 28, 2017 (CN) ..... 201710111732.1

(51) Int. Cl.
*E21B 7/06* (2006.01)
*E21B 17/05* (2006.01)
*E21B 17/10* (2006.01)

(52) U.S. Cl.
CPC ..... *E21B 7/067* (2013.01); *E21B 17/05* (2013.01); *E21B 17/1078* (2013.01)

(58) Field of Classification Search
CPC ..... E21B 7/067; E21B 17/05; E21B 17/1078
See application file for complete search history.

(56) References Cited

U.S. PATENT DOCUMENTS 5,542,482 A 8/1996 Eddison
5,875,859 A 3/1999 Ikeda et al.
(Continued)

FOREIGN PATENT DOCUMENTS

CN 103437704 A1 12/2013
CN 105569569 A 5/2016

OTHER PUBLICATIONS

Notification of Transmittal of the International Search Report and the Written Authority of the International Searching Authority; PCT/US2018/019508 filed Feb. 23, 2018; 16 pages.

*Primary Examiner* — Giovanna Wright
*Assistant Examiner* — Dany E Akakpo
(74) *Attorney, Agent, or Firm* — Cantor Colburn LLP

(57) ABSTRACT

A rotary steerable drilling system includes a collar, a drill bit, and a bit shaft connecting the drill bit to the collar. The bit shaft is coupled to the collar through a joint capable of transmitting a torque from the collar to the bit shaft and is swingable with respect to the collar around the joint. The system, further includes first eccentric wheel and second eccentric wheel coupled to the bit shaft and rotatable to swing the bit shaft with respect to the collar around the joint to change a drilling direction, a controller for controlling the first eccentric wheel and second eccentric wheel to harmoniously rotate such that the swing of the bit shaft substantially compensates rotation of the bit shaft, and an active stabilizer mounted on the bit shaft and capable of pushing the bit shaft to deviate to cause a lateral displacement and a tilt angle of the drill bit.

17 Claims, 7 Drawing Sheets

(56) References Cited

U.S. PATENT DOCUMENTS

| | | | | |
|---|---|---|---|---|
| 6,092,610 | A | 7/2000 | Kosmala et al. | |
| 2002/0175003 | A1 | 11/2002 | Pisoni et al. | |
| 2014/0209389 | A1 | 7/2014 | Sugiura et al. | |
| 2015/0114719 | A1* | 4/2015 | Pearce | E21B 7/04 175/61 |
| 2016/0326803 | A1* | 11/2016 | Winslow | E21B 3/00 |
| 2016/0356099 | A1* | 12/2016 | Kirkhope | E21B 47/024 |
| 2018/0002991 | A1* | 1/2018 | Patwa | E21B 7/061 |

* cited by examiner

HYBRID ROTARY STEERABLE SYSTEM AND METHOD

CROSS REFERENCE TO RELATED APPLICATIONS

This is a U.S. National Stage of Application No. PCT/US2018/012471, filed on Feb. 23, 2018, which claims the benefit of Chinese Patent Application No. 20170111732.1, filed on Feb. 28, 2017, the disclosures of which are incorporated herein by reference.

FIELD OF THE INVENTION

The present invention generally relates to a directional drilling system and method, and in particular, to a hybrid rotary steerable system and method that fuse point-the-bit and push-the-bit functions.

BACKGROUND OF THE INVENTION

An oil or gas well often has a subsurface section that needs to be drilled directionally. Rotary steerable systems, also known as "RSS," are designed to drill directionally with continuous rotation from the surface, and can be used to drill a wellbore along an expected direction and trajectory by steering a collar while it's being rotated. Thus rotary steerable systems are widely used in such as conventional directional wells, horizontal wells, branch wells, etc. Typically, there are two types of rotary steerable systems: "push-the-bit" systems and "point-the-bit" systems.

In the point-the-bit system, the point direction of the drill bit is changed by bending the bit shaft relative to the rest of the bottom hole assembly (BHA). In an idealized form, the drill bit of the point-the-bit system is not required to cut sideways because the bit axis is continually aligned with the direction of the wellbore being drilled.

In the push-the-bit system, the drilling direction is changed by applying a lateral force (a force in a steering direction that is at an angle with respect to the direction of wellbore propagation) to the collar to push the drill bit to deviate from the wellbore center. The lateral force usually is applied to the collar by an actuating unit, such as one or more pads. In an idealized form, the drill bit of the push-the-bit system is required to cut sideways in order to change the drilling direction.

Generally, the push-the-bit system has a high build-up rate but forms an unsmooth drilling trajectory and rough well walls, whereas the point-the-bit system forms relatively smoother drilling trajectory and well walls, but has a relatively lower build-up rate. How to improve the efficiency, build-up rate and wellbore quality in directional drilling for oil & gas exploitation is always a big challenge.

SUMMARY OF THE INVENTION

A rotary steerable drilling system includes a collar, a drill bit, and a bit shaft connecting the drill bit to the collar. The bit shaft is coupled to the collar through a joint capable of transmitting a torque from the collar to the bit shaft, and is swingable with respect to the collar around the joint. The rotary steerable drilling system further includes a first eccentric wheel and a second eccentric wheel coupled to the bit shaft and rotatable to swing the bit shaft with respect to the collar around the joint, a controller for controlling the first and second eccentric wheels to harmoniously rotate such that the swing of the bit shaft with respect to the collar substantially compensates rotation of the collar, and an active stabilizer mounted on the bit shaft and capable of pushing the bit shaft to deviate to cause a lateral displacement and a tilt angle of the drill bit to change a drilling direction.

A rotary steerable drilling method includes drilling a borehole with a drill bit coupled to a collar via a bit shaft, while rotating the collar, the bit shaft and the drill bit. The method further includes rotating a first eccentric wheel and a second eccentric wheel coupled to the bit shaft, to swing the bit shaft with respect to the collar around a joint adapted to connect the bit shaft to the collar and transmit a torque from the collar to the bit shaft. The method further includes controlling the first and second eccentric wheels to harmoniously rotate such that the swing of the bit shaft with respect to the collar substantially compensates rotation of the collar, and pushing the bit shaft to deviate to cause a lateral displacement of the drill bit, to change a drilling direction while the drilling, via an active stabilizer mounted on the bit shaft.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION OF THE INVENTION

One or more embodiments of the present disclosure will be described below. Unless defined otherwise, technical and scientific terms used herein have the same meaning as is commonly understood by one of skill in the art to which this invention belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean any, some, or all of the listed items. The use of "including," "comprising" or "having" and variations thereof herein are meant to encompass the items listed thereafter and equivalents thereof as well as additional items. The term "coupled" or "connected" or the like includes but is not limited to being connected physically or mechanically, and may be connected directly or indirectly.

Embodiments of the present disclosure relate to a rotary steerable drilling system and method and particularly a hybrid rotary steerable system and method for directional drilling a borehole or wellbore. The hybrid rotary steerable system and method incorporate point-the-bit and push-the-bit steering modes into a single scheme, and can greatly improve the build-up rate.

Figure 1:
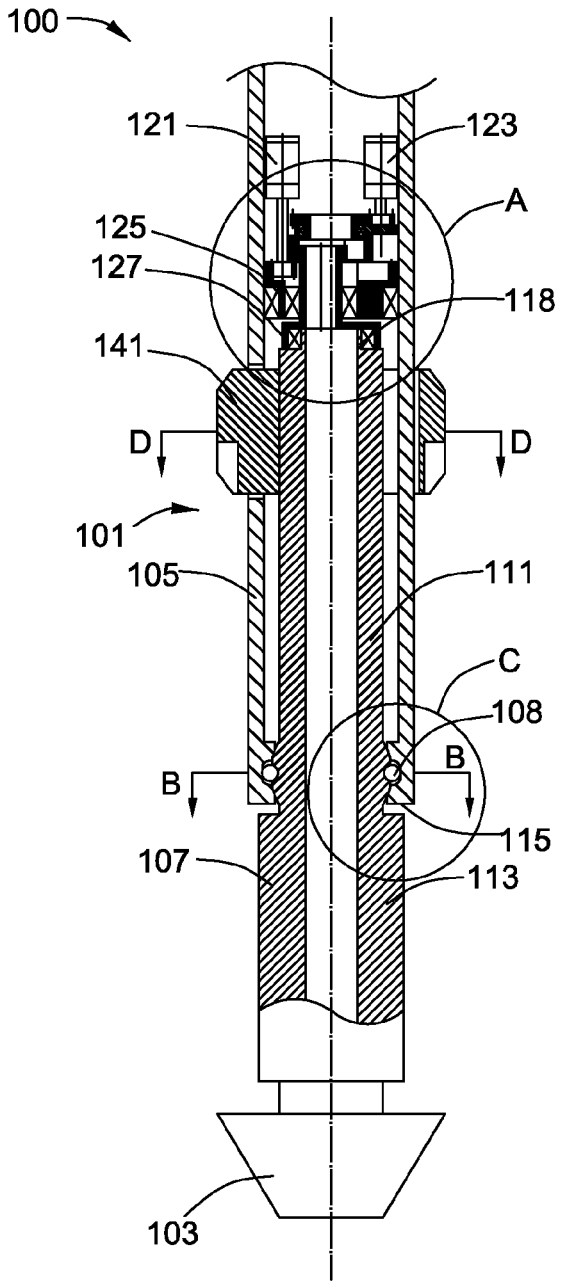
FIG. 1 is a schematic longitudinal section view of a portion of a hybrid rotary steerable system in accordance with one embodiment of the present disclosure, which shows a drill bit and a bottom hole assembly (BHA) of the hybrid rotary steerable system.

FIG. 1 is a schematic longitudinal section view of a portion of a hybrid rotary steerable system 100, which shows a bottom hole assembly (BHA) 101 and a drill bit 103 of the hybrid rotary steerable system 100. The drill bit 103 is coupled with a drill string (collar) 105 via a bit shaft 107. The bit shaft 107 is coupled with the collar 105 through a joint 108, around which the bit shaft 107 is swingable relative to the collar 105. The joint 108 may be a flexible joint such as a universal joint. Through such a flexible joint, the bit shaft 107 is swingable but not rotatable relative to the collar 105, and a torque can be transferred from the collar 105 to the bit shaft 107. In some embodiments, the bit shaft 107 has a longitudinal tubular shape, and includes an upper section 111 above the joint 108 and a lower section 113 below the joint 108. The joint 108 between the upper section 111 and the lower section 113 is coupled to the collar 105 near a front end 115 of the collar 105, having the upper section 111 within the collar 105 and the lower section 113 outside the collar 105. The swing of the bit shaft 107 relative to the collar 105 can cause the drill bit 103 tilted in a desired direction as in a point-the-bit system.

In addition, the hybrid rotary steerable system 100 further includes an active stabilizer 141 for pushing the bit shaft 107 and the collar 105 to deviate to generate a lateral displacement of the drill bit 103, like in a push-the-bit system. A combination of the tilt and the lateral displacement of the drill bit 103 increases the offset of the drill bit 103 to improve the build-up rate, comparing with a pure point-the-bit or push-the-bit system.

Figure 2:
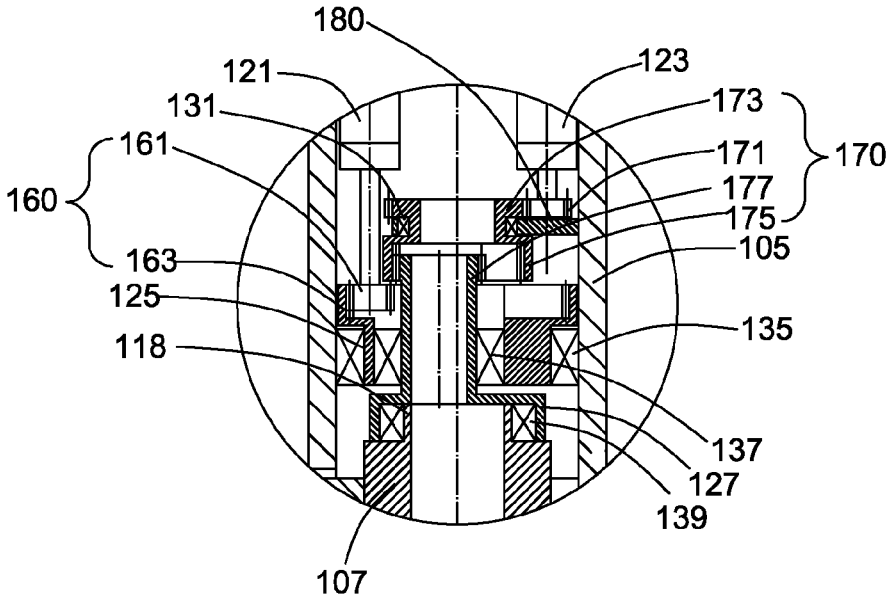
FIG. 2 is an enlarged view of the portion A as shown in FIG. 1.

FIG. 2 is an enlarged view of the portion A as shown in FIG. 1. As shown in FIG. 1 and FIG. 2, there are at least two motors 121 and 123 installed in the BHA 101. Each of the motors 121 and 123 may have an encoder (not shown) that converts mechanical motion into an electrical signal for motor speed and/or position measure and control. The two motors 121 and 123 rotate two eccentric wheels 125 and 127, respectively. In some embodiments, rotary axes of the eccentric wheels 125 and 127 are substantially in parallel with each other. Specifically, the first motor 121 drives the first eccentric wheel 125 to rotate, through a first gear drive train 160 including, for example, gears 161 and 163, and the second motor 123 drives the second eccentric wheel 127 to rotate, through a second gear drive train 170 including, for example, gears 171, 173, 175 and 177. In some embodiments, the first gear drive train 160 includes at least one gear fixed with the first eccentric wheel 125, and the second gear drive train 170 includes at least one gear fixed with the second eccentric wheel 127. As used herein, "fixed with the first or second eccentric wheel" means being one-piece formed with the first or second eccentric wheel, or being fixed to the first or second eccentric wheel via one or more fasteners such as bolts. As shown in FIG. 1 and FIG. 2, the gear 163 in the first gear drive train 160 is one-piece formed with the first eccentric wheel 125, and the gear 177 in the second gear drive train 170 is one-piece formed with the second eccentric wheel 127. The first motor 121 drives the gear 161 to drive the gear 163 fixed with the first eccentric wheel 125 and thereby drives the first eccentric wheel 125 to rotate, and the second motor 123 drives the gear 171 to drive the gear 173 and the gear 175 fixed with the gear 173, and the gear 175 drives the gear 177 fixed with the second eccentric wheel 127 and thereby drives the second eccentric wheel 127 to rotate. In a specific embodiment as shown in FIG. 1 and FIG. 2, the gear 173 is one-piece formed with the gear 175 and supported by a support 180 via a bearing 131. The support 180 is fixed with the collar 105.

In some embodiments, the two eccentric wheels 125 and 127 are coupled to the upper section 111 of the bit shaft 107, and particularly, are coupled to an upper axial end 118 of the bit shaft 107, whereas the drill bit 103 is coupled to the lower section 113 of the bit shaft 107, and particularly, is coupled to a lower axial end 119 of the bit shaft 107. In some specific embodiments, the drill bit 103 is fixed at the lower axial end 119 of the bit shaft 107.

As shown in FIG. 1 and FIG. 2, the eccentric wheels 125 and 127 are coupled to the bit shaft 107 through bearings around the upper end 118 of the bit shaft 107. In some embodiments, the two eccentric wheels 125 and 127 are coupled between the collar 105 and the bit shaft 107, wherein the eccentric wheel 125 is coupled between the eccentric wheel 127 and the collar 105 and the eccentric wheel 127 is coupled between the bit shaft 107 and the eccentric wheel 125. There is a first bearing 135 between the eccentric wheel 125 and the collar 105, a second bearing 137 between the two eccentric wheels 125 and 127, and a third bearing 139 between the eccentric wheel 127 and the bit shaft 107. By rotating the two eccentric wheels 125 and 127, the bit shaft 107 can be pushed to swing around the joint 108 to change the point direction of the drill bit 103, which makes the hybrid rotary steerable system 100 act as a point-the-bit system. The swing of the tubular bit shaft 107 can change the bit shaft 107 from being coaxial with the collar 105 to being uncoaxial with the collar 105.

Figure 3:
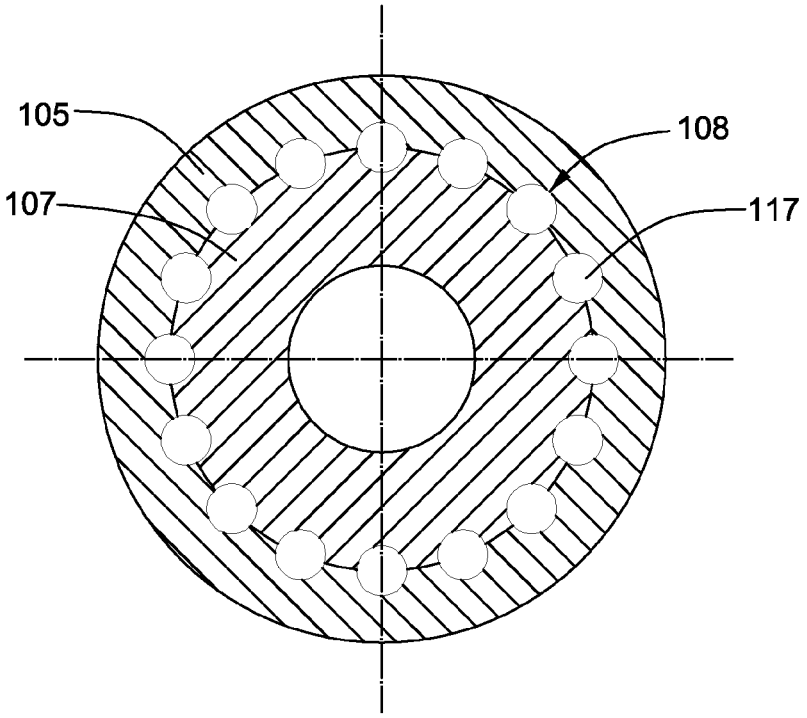
FIG. 3 is a schematic cross section view of the BHA of FIG. 1 taken along line B-B.
Figure 4:
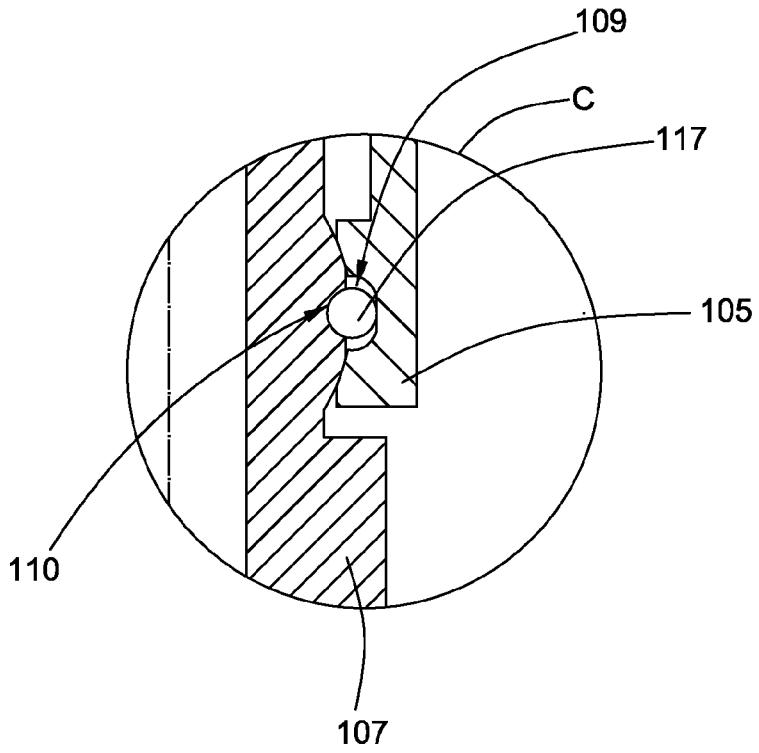
FIG. 4 is an enlarged view of the portion C as shown in FIG. 1.

In some embodiments, as illustrated in FIG. 3, the joint 108 is a ball-shape universal joint including a plurality of small balls 117. These small balls 117 transfer the torque from the collar 105 to the bit shaft 107, such that the collar 105 can rotate the bit shaft 107 and the drill bit 103 to cut rock while drilling. As illustrated in FIG. 1, each of these small balls 117 is contained in a space defined between the collar 105 and the bit shaft 107. In some embodiments, as illustrated in FIG. 4, there is a groove 109 defined in the collar 105 and a cavity 110 defined in the bit shaft 107 corresponding to each of the small balls 117, and the groove 109 and the cavity 110 together form a closed space for accommodating the small ball 117. The closed space is surplus for the ball 117 along an axial direction of the collar 105, to allow the bit shaft 107 to swing relative to the collar 105 around the joint 108. In some specific embodiments, the cavity 110 defined in the bit shaft 107 conforms to the size and shape of the ball 117, whereas the groove 109 defined in the collar 105 is surplus for the ball 117 along the axial direction of the collar 105.

Returning to FIG. 1 and FIG. 2, while directional drilling, the two motors 121 and 123 drive the eccentric wheels 125 and 127 to tilt the bit shaft 107 with respect to the collar 105 at the joint 108, to generate a tilt angle between the collar 105 and the bit shaft 107 around the joint 108. There is at least one measurement module such as a measurement while drilling (MWD) module (not shown) and at least one controller (not shown) in the hybrid rotary steerable system 100. The measurement module may be used to measure rotation and gesture parameters of the collar 105 and the bit shaft 107 in real-time. Based on the measured parameters, the controller can control the two motors 121 and 123 to harmoniously rotate the two eccentric wheels to push the bit shaft 107 to swing in a manner that the swing substantially compensates the rotation of the collar 105 to keep the drill bit 103 stably pointing to a desired direction, like in a point-the-bit system. Specifically, the bit shaft 107 swings to make sure the tilt of the drill bit 103 is actively maintained in the desired direction with respect to the formation being drilled, as in a point-the-bit system.

Figure 5:
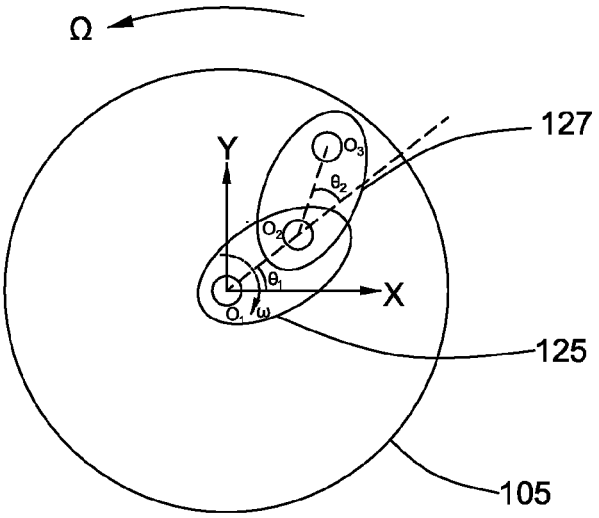
FIG. 5 is a schematic view illustrating interaction of two eccentric wheels of the hybrid rotary steerable system of FIG. 1.

In some embodiments, the swing of the bit shaft 107 is controlled via movements of the first and second eccentric wheels 125 and 127. As illustrated in FIG. 5 and FIG. 1, $O_1$ is the center of the collar 105 or the bearing 135 (also the rotary axis of the first eccentric wheel 125), $O_2$ is the center of the bearing 137 (also the rotary axis of the second eccentric wheel 127), and $O_3$ is the center of the bearing 139 (also the center of the upper end 118 of the bit shaft 107). $O_1XY$ is a coordinate system coupled to the collar through $O_1$. But the coordinate system does not rotate along with the collar. $\theta_1$ is an angle between line $O_1O_2$ and the X axis, and $\theta_2$ is an angle between line $O_1O_2$ and line $O_2O_3$.

During drilling, the collar 105 rotates with an angular speed $\Omega$. The first eccentric wheel 125 rotates with an angular speed $\omega$ with respect to collar 105. If $\Omega$ is equal to $\omega$ but with an inverse direction, the first eccentric wheel 125 can keep stationary to the fixed coordinate system $O_1XY$. So the first eccentric wheel 125 has no rotation to the well. Further, the second motor 123 can be controlled to keep the $\theta_2$ substantially constant, for example, by rotating the second motor 123 with respect to collar 105 at a controlled speed, such that the active stabilizer bias displacement and the point direction of the drill bit 103 can be kept stable. Thus, the system can stably drill the borehole.

In some embodiments, a distance between $O_1$ and $O_2$ is substantially equal to a distance between $O_2$ and $O_3$. When $\theta_2$ is equal to 180 degree, $O_3$ overlaps with $O_1$, the bit shaft 107 is not tilted with respect to the collar 105 and the bit shaft 107 has no bias displacement, thus the drill bit drills along a straight line. When $O_3$ doesn't overlap with $O_1$, the active stabilizer 141 can keep a bias displacement that is proportional to a distance between $O_1$ and $O_3$ ($O_1O_3$), and particularly is very close to the distance $O_1O_3$. Therefore, when $O_3$ doesn't overlap with $O_1$, and $O_1$ and $O_2$ are kept substantially constant, the drill bit drills along an arc trajectory and the build-up rate is kept stable.

In some specific embodiments, w is kept to be equal to $\Omega$ with an inverse direction during drilling. By controlling $\theta_1$ and $\theta_2$, the drilling direction can be continuously changed and the drill bit can move forward along an expected trajectory.

Figure 6:
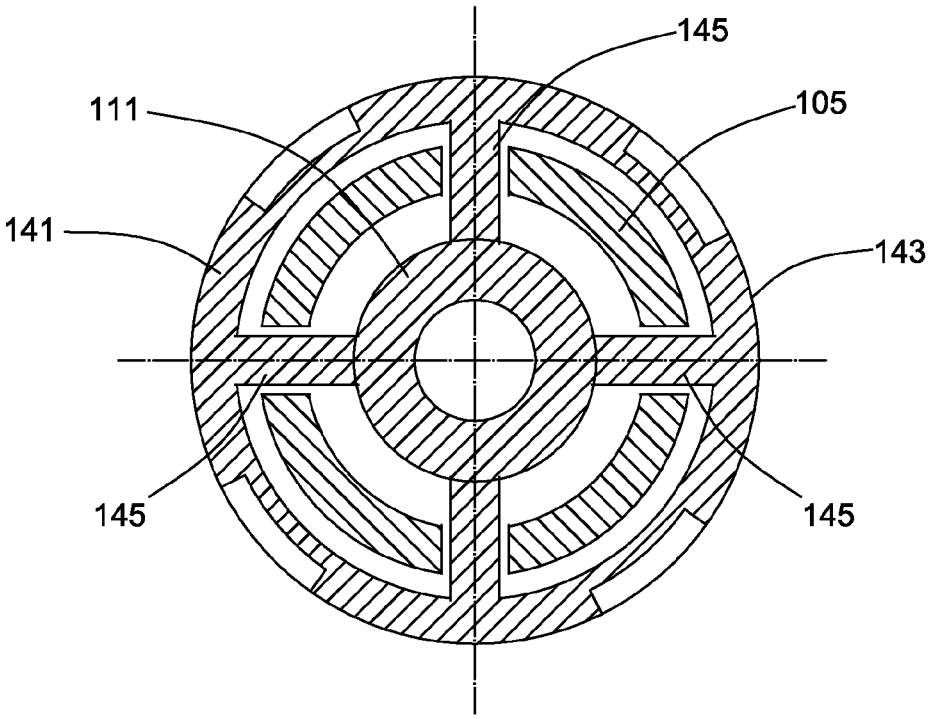
FIG. 6 is a schematic cross section view of the BHA of FIG. 1 taken along line D-D.

FIG. 6 illustrates a cross section view of the active stabilizer 141 taken along line C-C in FIG. 1. In some embodiments, as illustrated in FIG. 1 and FIG. 6, the active stabilizer 141 is fixed on the upper section 111 of the bit shaft 107 near the upper end 118 of the upper section 111 (which also is the upper end of the bit shaft 107), and has an outer surface 143 for contacting an inner surface of a borehole (not shown in FIG. 1 and FIG. 6) drilled by the drill bit. There are ribs 145 passing through the collar 105 and extending between an outer surface of the upper section 111 and the outer surface 143 of the active stabilizer 141. In particular, the outer surface 143 is an annular surface supported by the ribs 145, and there may be grooves on the annular surface for mud to pass through. When rotating the two eccentric wheels 125 and 127, the active stabilizer 141 is constrained by the borehole and its outer surface 143 abuts on the inner surface of the borehole and applies a lateral force to the inner surface of the borehole. The counterforce of the lateral force applied to the active stabilizer 141 and the bit shaft 107 fixed with the active stabilizer 141 pushes the collar 105 via the joint 108 to deviate to generate a lateral displacement, which makes the hybrid rotary steerable system 100 act as a push-the-bit system. At the same time, the lateral displacement of the collar 105 at the joint 108 causes a tilt angle between the collar 105 and the bit shaft 107, which makes the hybrid rotary steerable system act as a point-the-bit system.

Figure 7:
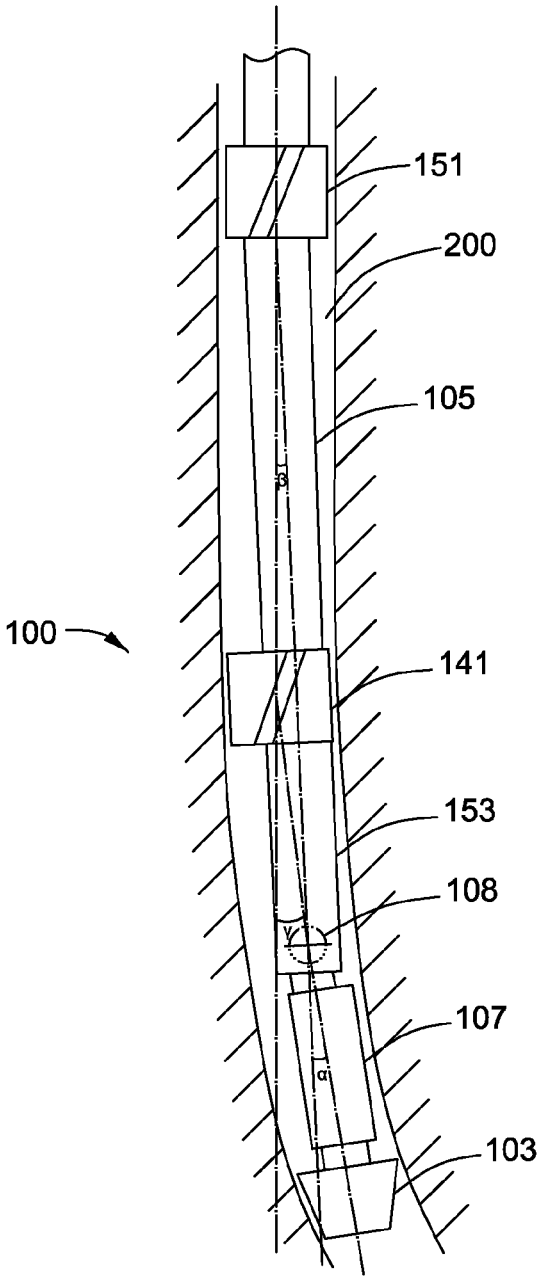
FIG. 7 is a schematic view illustrating a status of the hybrid rotary steerable system of FIG. 1 when it is used to steer to establish or change curvature during drilling.

FIG. 7 illustrates a status of the hybrid rotary steerable system 100 when it steers to change the drilling direction while drilling a well 200. As shown in FIG. 7, the hybrid rotary steerable system 100 further includes one or more fixed stabilizers (only the fixed stabilizer 151 closest to the active stabilizer 141 is shown) fixed on the collar 105. When the hybrid rotary steerable system 100 steers to change the drilling direction, the motors 121 and 123 (shown in FIG. 1) and the active stabilizer 141 cooperatively drive the bit shaft 107, the drill bit 103 fixed on the bit shaft 107, and a section 153 of the collar 105 that is between the joint 108 and the fixed stabilizers 151 closest to the active stabilizer 141, to gradually deviate to generate a deviating angle $\beta$ between the rotation axis of the collar section 153 and an axis of the well 200 near the fixed stabilizers 151. The motors 121 and 123 and the active stabilizer 141 also cooperatively drive the bit shaft 107 to tilt around the joint 108 with respect to the collar section 153 with a tilt angle $\alpha$ between a rotation axis of the bit shaft 107 (which is also the rotation axis of the drill bit 103) and a rotation axis of the collar section 153.

The dual effect makes an angle $\gamma$ between the rotation axis of the drill bit 103 and the axis of the well 200 near the fixed stabilizers 151 approximately equal to a sum of $\alpha$ and $\beta$, i.e., $\gamma \approx \alpha + \beta$. It can be seen that, the angle between the rotation axis of the drill bit 103 and the axis of the well 200 near the fixed stabilizers 151 significantly increases comparing with a pure point-the-bit or push-the bit system of the prior art, which means that the build-up rate is significantly improved. In addition, due to the active stabilizer and the stable control, the drilling trajectory can be more smooth and the well quality can be improved.

The hybrid rotary steerable system as described herein above steers in a hybrid manner incorporating point-the-bit and push-the-bit steering modes. The fused point-the-bit and push-the-bit functions can improve the build-up rate as the bit shaft 107 is pushed to generate a lateral displacement and a tilt angle of the drill bit 103 in a same direction by the active stabilizer 141 and the two eccentric wheels 125 and 127.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A rotary steerable drilling system for drilling a borehole, comprising:

a collar;

a drill bit;

a bit shaft connecting the drill bit to the collar, the bit shaft coupled to the collar through a joint capable of transmitting a torque from the collar to the bit shaft, and swingable with respect to the collar around the joint;

a first eccentric wheel and a second eccentric wheel coupled to the bit shaft, and rotatable to swing the bit shaft with respect to the collar around the joint causing a tilt angle of the drill bit;

a controller for controlling the first and second eccentric wheels to rotate such that the swing of the bit shaft with respect to the collar substantially compensates rotation of the collar; and a stabilizer fixedly mounted on the bit shaft and rotatable with the bit shaft, the stabilizer being capable of contacting an inner surface of the borehole to push the collar via the joint to generate a lateral displacement, wherein the lateral displacement and the tilt angle of the drill bit changes a drilling direction.

2. The system according to claim 1, wherein the bit shaft has opposite first and second axial ends, the joint is between the first and second axial ends, and the drill bit is coupled to the first axial end of the bit shaft and the first and second eccentric wheels are coupled to the second axial end of the bit shaft.

3. The system according to claim 1, wherein the bit shaft comprises an upper section within the collar and a lower section outside the collar, and the stabilizer is fixed on the upper section of the the bit shaft.

4. The system according to claim 3, wherein the stabilizer has an outer surface for contacting an inner surface of the borehole, and the stabilizer comprises ribs extending between the outer surface thereof and an outer surface of the bit shaft, the ribs passing through the collar.

5. The system according to claim 1, wherein the joint is located between the drill bit and the stabilizer along an axial direction of the bit shaft.

6. The system according to claim 1, wherein the joint is a universal joint.

7. The system according to claim 6, wherein the universal joint includes a plurality of balls, each of the balls contained in a space defined between the collar and the bit shaft, wherein the space is surplus for the ball along an axial direction of the collar to allow the bit shaft to swing with respect to the collar around the joint.

8. The system according to claim 1, wherein the first eccentric wheel is coupled between the collar and the second eccentric wheel and the second eccentric wheel is coupled between the first eccentric wheel and the bit shaft.

9. The system according to claim 1, further comprising a first motor and a second motor for driving the first eccentric wheel and the second eccentric wheel, respectively.

10. The system according to claim 9, wherein the first and second motors drive the first and second eccentric wheels through a gear drive train respectively, the gear drive train comprising at least one gear fixed with the first eccentric wheel or the second eccentric wheel.

11. The system according to claim 9, further comprising a measurement module, the measurement module measuring one of a rotation parameter and a gesture parameter of one of the collar and the bit shaft.

12. The system according to claim 11, wherein the controller controls at least one of the first motor and the second motor based on the at least one of the rotation parameter and the gesture parameter measured by the measurement module.

13. The system according to claim 1, wherein a distance between a rotary axis of the first eccentric wheel and a rotary axis of the second eccentric wheel is substantially equal to a distance between the rotary axis of the second eccentric wheel and a center of an upper end of the bit shaft.

14. The system according to claim 1, wherein the controller controls the first and second eccentric wheel to swing the bit shaft to keep the drill bit pointing to a specific direction with respect to a formation being drilled.

15. The system according to claim 1, wherein the controller controls the first eccentric wheel and the second eccentric wheel to rotate such that the swing of the bit shaft with respect to the collar substantially compensates rotation of the stabilizer.

16. A rotary steerable drilling method, comprising:

drilling a borehole with a drill bit coupled to a collar via a bit shaft, while rotating the collar, the bit shaft and the drill bit;

rotating a first eccentric wheel and a second eccentric wheel coupled with the bit shaft, to swing the bit shaft with respect to the collar around a joint adapted to connect the bit shaft to the collar and transmit a torque from the collar to the bit shaft, the swing of the bit shaft causing a tilt angle of the drill bit;

controlling the first and second eccentric wheels to harmoniously rotate such that the swing of the bit shaft substantially compensates the rotation of the collar; and pushing the collar with a stabilizer fixedly mounted on the bit shaft and rotating with the bit shaft the stabilizer being capable of contacting an inner surface of the borehole such that the collar generates a lateral displacement, wherein the lateral displacement and the tilt angle of the drill bit, changes a drilling direction.

17. The method according to claim 16, wherein the collar is rotated with respect to the borehole at a first angular speed $\Omega$, the first eccentric wheel is rotated with respect to the collar at a second angular speed $\omega$, and the second eccentric wheel is rotated to keep the second eccentric wheel at an expected angle with respect to the first eccentric wheel while changing the drilling direction, wherein the first angular speed $\Omega$ and the second angular speed co are substantially equal and opposite in direction.

* * * * *